US005361549A

United States Patent [19]

Betts

[11] Patent Number: 5,361,549

[45] Date of Patent: Nov. 8, 1994

[54] PRESSURE RELIEF PANELS AND LOUVERS

[75] Inventor: Kenneth H. Betts, Mississauga, Canada

[73] Assignee: C/S Construction Specialties Ltd., Mississauga, Canada

[21] Appl. No.: 871,591

[22] Filed: Apr. 13, 1992

Related U.S. Application Data

[63] Continuation of Ser. No. 700,893, May 10, 1991, abandoned, which is a continuation of Ser. No. 430,967, Nov. 1, 1989, abandoned, which is a continuation of Ser. No. 370,135, Jun. 22, 1989, abandoned, which is a continuation of Ser. No. 35,841, Apr. 8, 1987, abandoned.

[51] Int. Cl.[5] ..... E04H 14/00; E05C 19/16

[52] U.S. Cl. ..... 52/1; 52/208; 49/141; 292/251.5

[58] Field of Search ..... 52/1, 202, 208, DIG. 4; 49/141; 292/251.5

[56] References Cited

U.S. PATENT DOCUMENTS

| | | | |
|---|---|---|---|
| 1,254,517 | 1/1918 | Lumm . | |
| 3,258,890 | 7/1966 | Dirkse . | |
| 3,453,777 | 7/1969 | Reilly . | |
| 3,521,546 | 7/1970 | Day . | |
| 3,539,214 | 11/1970 | Fisher | 292/251.5 |
| 3,557,497 | 1/1971 | Schafer . | |
| 3,730,577 | 5/1973 | Shanok | 292/251.5 |
| 3,864,881 | 2/1975 | Wolf | 52/1 |
| 3,924,377 | 12/1975 | Gill | 52/DIG. 4 |
| 3,950,894 | 4/1976 | Di Maio | 292/251.5 |
| 4,079,558 | 3/1978 | Gorham | 52/202 |
| 4,099,755 | 7/1978 | Anderson | 292/251.5 |
| 4,194,771 | 3/1980 | Biggs . | |
| 4,269,376 | 5/1981 | Haux . | |
| 4,272,942 | 6/1981 | Jackson | 52/202 |
| 4,276,725 | 7/1981 | Ash | 52/1 |
| 4,327,241 | 4/1982 | Obsenchain . | |
| 4,361,985 | 12/1982 | DeMarco . | |
| 4,389,827 | 6/1983 | Valkenburg | 52/202 |

FOREIGN PATENT DOCUMENTS

| | | | |
|---|---|---|---|
| 625008 | 8/1978 | U.S.S.R. | 52/1 |

OTHER PUBLICATIONS

I.B.M. Technical Disclosure Bulletin: vol. 11, No. 11 (Apr. 1969).

*Primary Examiner*—Michael Safavi
*Attorney, Agent, or Firm*—Bereskin & Parr

[57] ABSTRACT

A pressure relief panel assembly for buildings in which explosions may occur includes a panel pivotally coupled to a frame for movement between a normal closed position and an open position and a calibrated magnet and striker set for holding the panel in its closed position. The magnet has a maximum holding force substantially in excess of a known force to which it is subjected at a predetermined blow-out pressure and a striker has secured thereto at least one non-magnetic shim defining a face for contact with the magnet. The shim thickness is selected to reduce the effective holding force exerted on the striker by the magnet, to the said known force.

24 Claims, 10 Drawing Sheets

26

32
30
32
32
3
38
36
38
3
34
34
28
26
26
30

PRESSURE RELIEF PANELS AND LOUVERS

This is a continuation of application Ser. No. 07/700,893 filed May 10, 1991, which is a continuation of application Ser. No. 07/430,967 filed Nov. 1, 1989, which is a continuation of application Ser. No. 07/370,135 filed, Jun. 22, 1989, which is a continuation of application Ser. No. 07/035,841 filed Apr. 8,1987, all of which are now abandoned.

FIELD OF THE INVENTION

This invention relates generally to pressure relief or "blow-out" panels and the like, intended for use in buildings in which there is a risk of explosion.

1. Background of the Invention

In buildings such as laboratories, testing facilities and manufacturing plants in which explosions or unwanted pressures may occur, it is conventional to incorporate in the roof and/or walls of the building, panels that will blow-out to relieve the pressure that would result from an over-pressure condition inside the building. This is necessary to prevent the building from collapsing and to minimize injury to persons inside the building.

The blow-out panels are typically retained by mechanical devices such as shear bolts that are designed to break under a predetermined pressure and allow the panel to blow out. A difficulty with this type of system is that is difficult to adjust accurately the pressure at which a particular panel will blow-out. In addition, as the system ages, the pressure at which blow-out will occur tends to increase. Further, when a panel has blown out, part or of the panel or at least the shear bolts are destroyed and must be replaced.

2. Description of the Prior Art

The following United States patents were considered in the preparation of the present application:

| | | | |
|---|---|---|---|
| 3,453,777 | Reilly | 1,254,517 | Lumm |
| 3,521,546 | Day | 3,539,214 | Fisher |
| 3,864,881 | Wolf | 4,194,771 | Biggs |
| 3,258,890 | Dirkse | 2,471,634 | Mark |
| 4,276,725 | Ash | 4,361,985 | DeMarco |
| 4,327,241 | Obsenchain | 3,557,497 | Schafer |
| 4,269,376 | Haux | 3,730,577 | Shanok |

These patents show various examples of prior art pressure relief panels. For example, the Wolf patent (U.S. Pat. No. 3,864,881) shows an example of a system in which the entire panel blows out and cannot be resealed. Reilly (U.S. Pat. No. 3,453,777) discloses a pressure venting window panel assembly. Ash (U.S. Pat. No. 4,276,725) shows a pressure relief panel that is held closed by sealing tape which must be replaced each time the panel blows out. Louvers which will be forced open under pressure are shown by the Day and Lumm patents (U.S. Pat. Nos. 3,521,546 and 1,254,517 respectively).

The patents to Fisher and Biggs (U.S. Pat. Nos. 3,539,214 and 4,194,771) disclose magnetic door catches.

U.S. Pat. No. 2,471,624 (Mark) shows a magnetic seal for use in refrigerators and the like.

An object of the present invention is to provide an improved pressure relief panel assembly which can be accurately set to blow-out at a predetermined pressure and which can also be re-closed or self closed and sealed after use. A further object is to provide a louver assembly which can also perform these functions. A still further object is to provide a method of making a panel release means for a pressure relief panel or louver assembly.

SUMMARY OF THE INVENTION

In one aspect, the invention provides a pressure relief panel assembly comprising a frame, a panel pivotally coupled to the frame for movement between a normal closed position and an open position and panel release means normally holding the panel in its closed position bun adapted to release when the panel is subjected to a predetermined blow-out pressure. The panel release means includes a calibrated magnet and striker set, one of which is carried by the panel and the other of which is adapted be secured to fixed structure, e.g. the frame. The magnet has a maximum holding force substantially in excess of a known force to which it is subjected at the said predetermined blow-out pressure and the striker has secured thereto at least one non-magnetic shim defining a face for contact with the magnet. The shim thickness is selected to reduce the effective holding force excerted on the striker by the magnet, to the said known force.

As noted previously, magnetic catches for doors have previously been proposed. However, they have not been suitable for use with pressure relief panels because the magnetic forces vary substantially from one magnet another, e.g. by as much as plus or minus 25 to 30%. In accordance with the invention, the magnetic holding force is reduced by one or more shims to a predetermined force corresponding blow-out pressure of the panel.

In another aspect of the panel, the panel assembly includes multiple panels in the form of slots forming a louver that is designed to blow-out at a predetermined pressure but are normally held closed by the panel release means of the invention.

BRIEF DESCRIPTION OF THE DRAWINGS

In order that the invention may be more clearly understood, reference will now be made to the accompanying drawings which illustrated a number of preferred embodiments to the invention by way of example, and in which.

DESCRIPTION OF PREFERRED EMBODIMENTS

Figure 1:
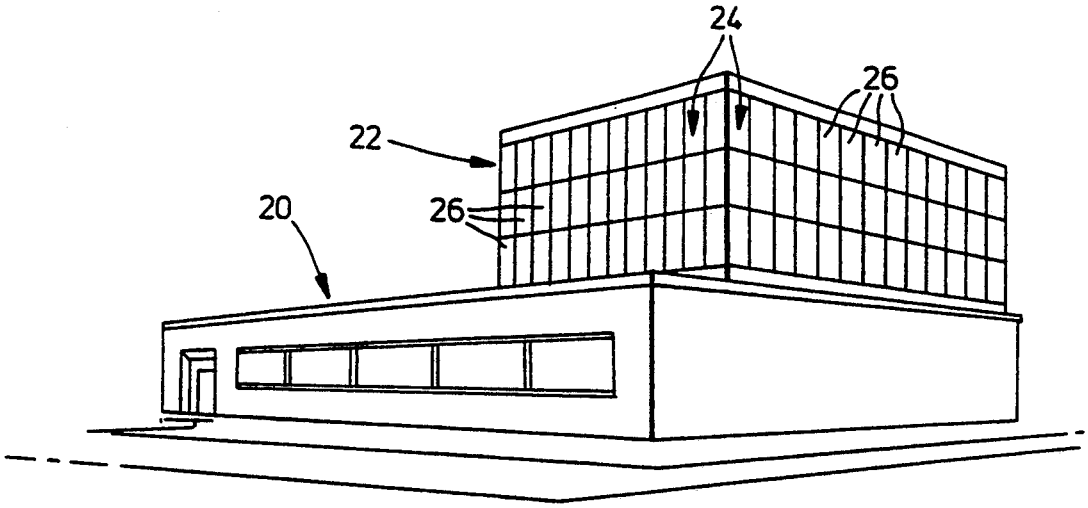
FIG. 1 is a perspective view of a typical building provided with arrays of pressure relief wall panels.
Figures 2, 2A:
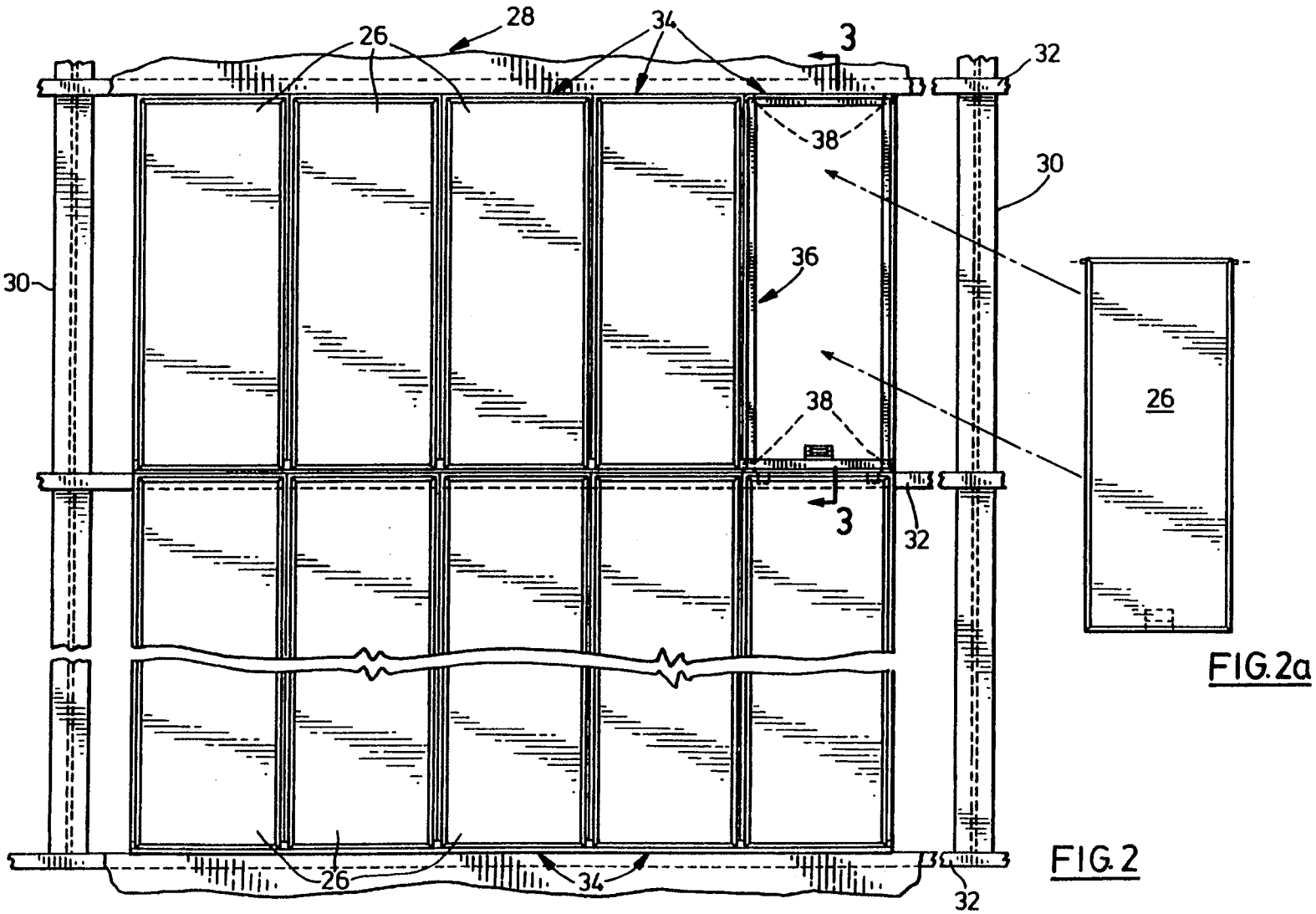
FIG. 2 is a front elevational view of part of one of the panel arrays shown in FIG. 1.
FIG. 2*a* shows one of the panels separate from the array.

Referring first to FIG. 1, a building is generally denoted by reference to 20 and includes a section 22, for example, a laboratory section, in which there is a risk of explosions. The walls of section 22 are formed by arrays 24 of pressure relief or "blow-out" wall panels 26. FIG. 2 shows part of one of the arrays 24 and FIG. 2*a* shows a typical one of the panels 26 removed from the array.

Referring to these views, the basic structure of the building is generally indicated by reference numeral and includes columns 30 and cross members 32 extending between the columns. Pressure relief wall panel assemblies 34 including the panels 26 are mounted between each vertically adjacent pair of cross members 32.

Figure 3:
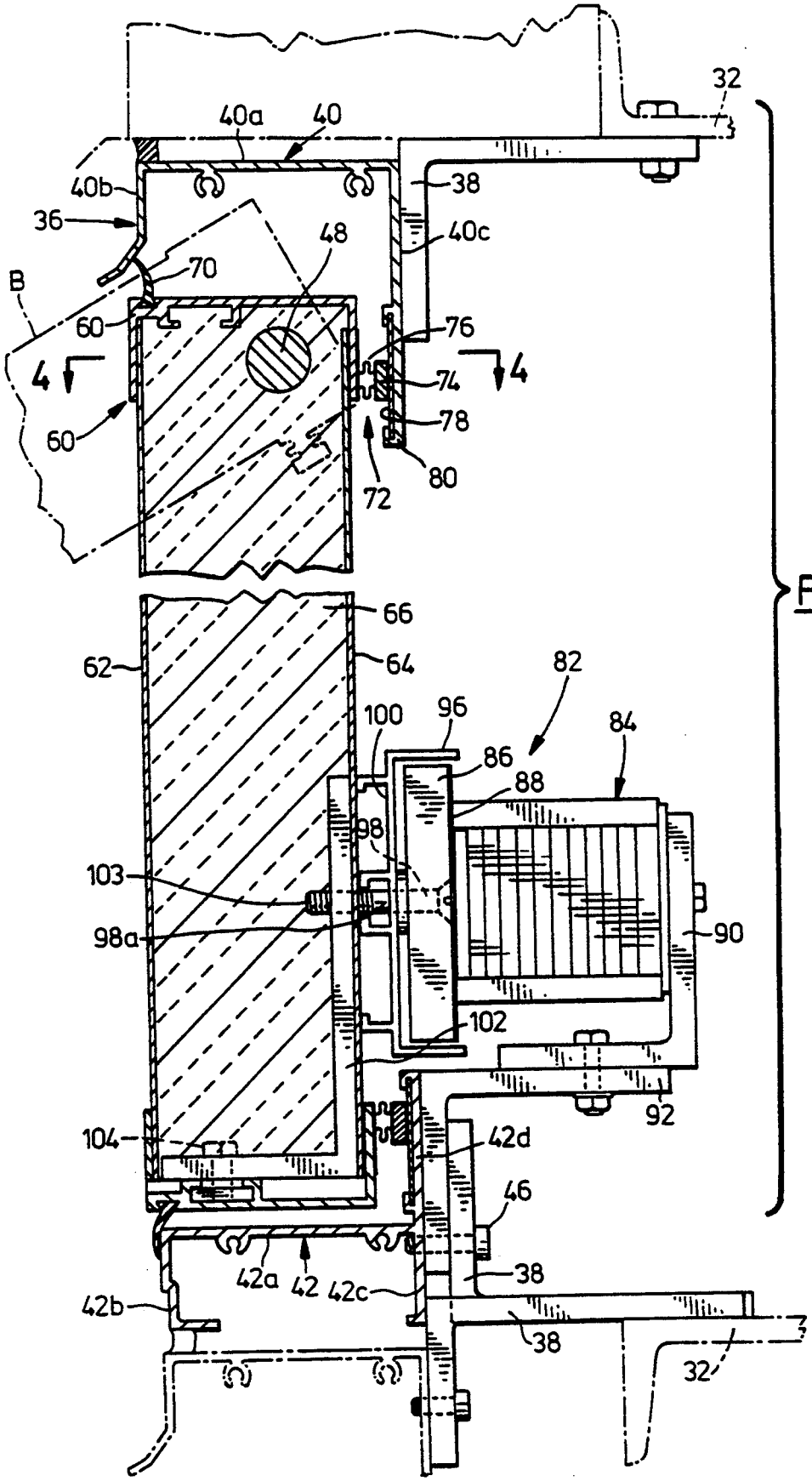
FIG. 3 is a vertical sectional view on line 3—3 of FIG. 2.

FIG. 3 is a vertical sectional view through a typical one of the wall panel assemblies 34 and will now be described as representative of all of the wall panel assemblies. The assembly includes a frame 36 which surrounds the actual panel 26 and which is connected to the building cross members 32 by four clips or brackets two of which are indicated at 38 in FIG. 3. Each panel assembly is in fact secured by four such clips. By way of example, the four clips that hold the panel assembly 34 at the top right hand corner of the array are shown in FIG. 2. It can be seen from this view that two clips 38 are provided at the top corners of the assembly and that two similar brackets are provided along the bottom edge, but inset slightly from the corners.

Referring back to FIG. 3, frame 36 is made up of four frame members each in the form of an aluminum extrusion of generally channel shape in cross-section. The extrusion forming the top frame member is denoted by reference numeral 40 and has a base 40*a* and front and rear limbs 40*b* and 40*c* respectively. The bottom frame member is generally denoted 42 and has a somewhat different cross-sectional shade, formed by a base 42*a* and limbs 42*b* and 42*c* defining with the base a channel facing downwardly away from the panel. Limb 42*c* is extended inwardly as indicated at 42*d* behind the panel. Extrusions of the same cross sectional shape as extrusion 42 are used as the side members of the frame; one of those side members is visible at 44 in FIG. 4.

The frame support clips 38 (see FIG. 3) are bolted to the frame itself through the inner limbs of the side and bottom members of the frame. One of the bolts that engages the inner limb of the bottom frame member 42 is visible at 46 in FIG. 3.

Figure 4:
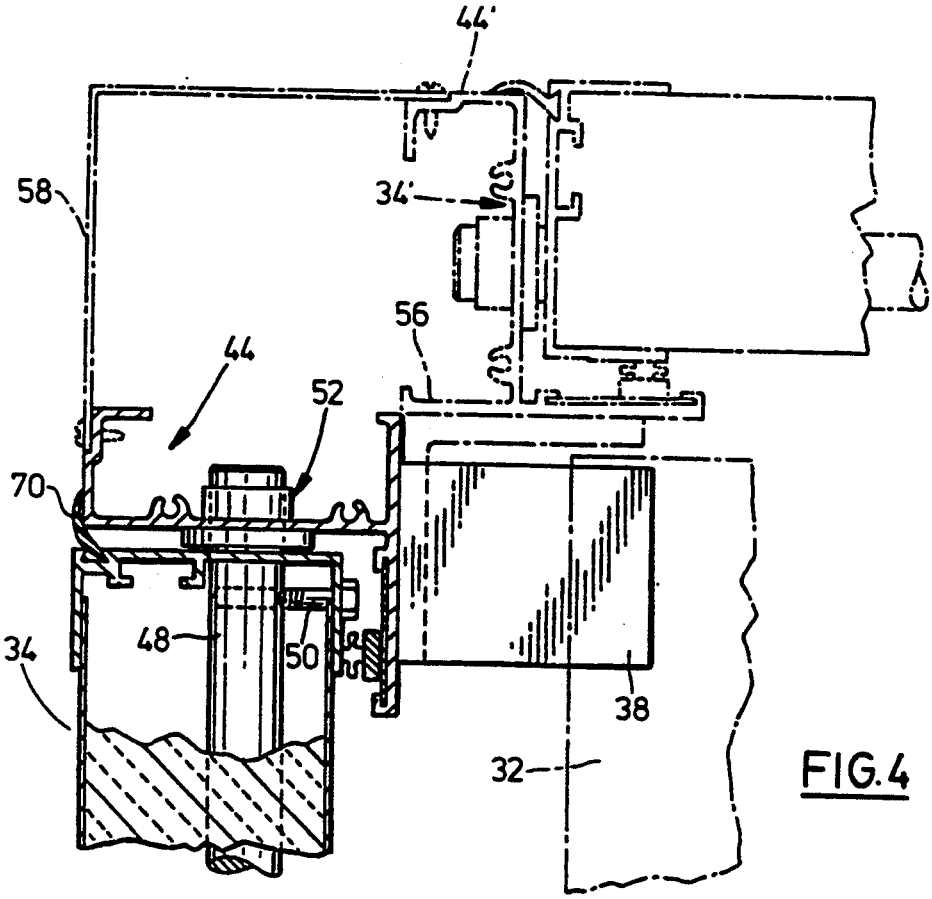
FIG. 4 is a horizontal sectional view generally on line 4—4 of FIG. 3 taken at a corner of the building to show the panel arrangement at the corner.

Panel 26 is pivotally coupled to the frame 36 for movement between the normally closed position in which it is shown in full lines in FIG. 3 and an open position indicated partly in ghost outline at B in FIG. 3. In this embodiment, the panel is pivotally supported adjacent its upper end on a pivot shaft 48 that extends through the panel and then outwardly through the side members of frame 36. FIG. 4 shows an end portion of shaft 48 extending through frame side member 44 and is typical of the mounting of the pivot shafts of all of the panels. The shaft is held stationary with respect to the panel by a set bolt 50 carried by the panel. The end portion of shaft 48 then extends through a complementary opening in frame member 44 and is journaled a flanged NYLON bushing 52 which is pressed into member 44.

FIG. 4 also shows the arrangement of two adjacent pressure relief panel assemblies at a corner of the building. A second panel assembly similar to the one that has just been described is shown in ghost outline at 34′ prime. An inner angle section member 56 connects the side frame members of the two panel assemblies and supports panel assembly 34′ from the building cross member 32 by way of clip 38. At the outer side of the corner, an angle section trim member 58 extends between the outer limbs of the respective frame side members 44 and 44′.

It will be seen from FIGS. 3 and 4 that the panel itself includes a peripheral frame 60 formed by four channel section members that extend around the four sides of the panel. Respective inner and outer "skins" 62 and 64 of the panel define an internal space that is filled with insulation 66. Frame 60 embraces the composite structure formed by the inner and outer skins 62 and 64 and the insulation 66. The extrusion from which the frame is formed includes an undercut slot 68 that receives a seal member 70 at the outer side of the panel. Similar seal members 70 extend along the top and bottom edges (FIG. 3) and down both sides of the panel (as shown for one side in FIG. 4). The seal members 70 are bonded together at corner joints. Along the sides and bottom edge, the seal members 70 overlie the corresponding members of frame 36 when panel is closed, while along the top edge, the seal member extends inside the outer limb 40*b* of frame member 40 and the limb is angled outwardly to some extent to form a water run-off. This seal arrangement prevents damage to the seals as the panel 26 moves from its closed position to its open position.

Additional weather seals are provided around the perimeter of the inner side of the panel and take the form of magnetic seals denoted by reference to numeral 72. Again, seals are provided along the top, bottom and side edges of the panel and the seals are bonded together at corner joints. The top and bottom edge seals are seen in FIG. 3 while one of the side edge seals is visible in FIG. 4. Referring to the top edge seal shown in FIG. 3 as typical of all four seals, it will be seen that the seal comprises a flexible strip magnet 74 carried by a flexible rubber bellows 76 from the panel, and a co-operating magnetically attractible plate 78 carried by the frame 36. The bellows 76 is mechanically attached to the inner limb of the panel frame member 60 (e.g. by adhesive) while the plate 78 is retained in a slot 80 formed in the extrusion that forms the top member 40 of frame 36. When the panel moves to its open position, the seal will separate at the inner face between the magnet 74 and plate 78; the magnet 74 and bellows 76 will then move with the panel as shown in ghost outline at 72. When the panel returns to its closed position, the seal will automatically close due to the magnetic attraction between magnet 74 and plate 78. The seal arrangement is essentially identical at the bottom and side edges of the panel.

Panel assembly 34 also includes panel release means generally indicated by reference numeral 82, for normally holding the panel in its closed position while permitting the panel to release and move to its open position when subjected to a predetermined blow-out pressure from within the building. The panel release means takes the form of a calibrated magnet and striker set one of which is carried by the panel and the other of which is fixed. In this embodiment, the magnet is fixed and is denoted by reference numeral 84 and the striker plate is indicated at 86 and moves with the panel. As will be described in more detail later, the magnet has a maximum holding force substantially in excess of a known force when a predetermined blow-out pressure is exerted on the panel. A non-magnetic shim 88 is secured to the outer face of the striker and in effect defines the face that contacts the magnet. The thickness of the shim is selected during manufacture of the panel release means to reduce the effective holding force exerted on the striker 86 by the magnet 84 to the known force at which the panel should release. In other words, the magnet and striker set 84, 86 is precisely calibrated to release the panel at a predetermined blow-out pressure.

Figure 11:
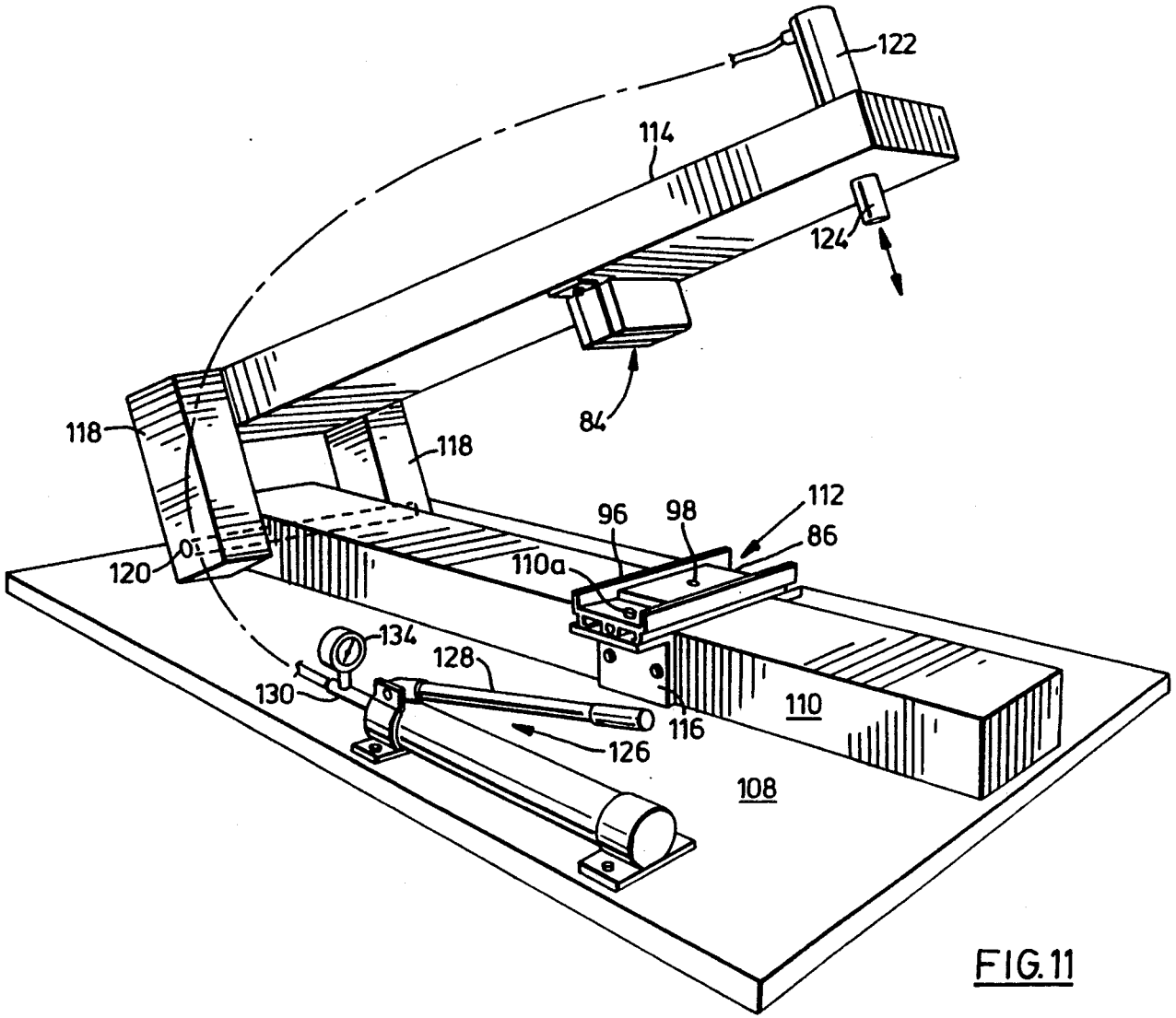
FIG. 11 is a perspective illustration of a calibration jig for use in making the panel and louver assemblies illustrated previously.
Figure 12:
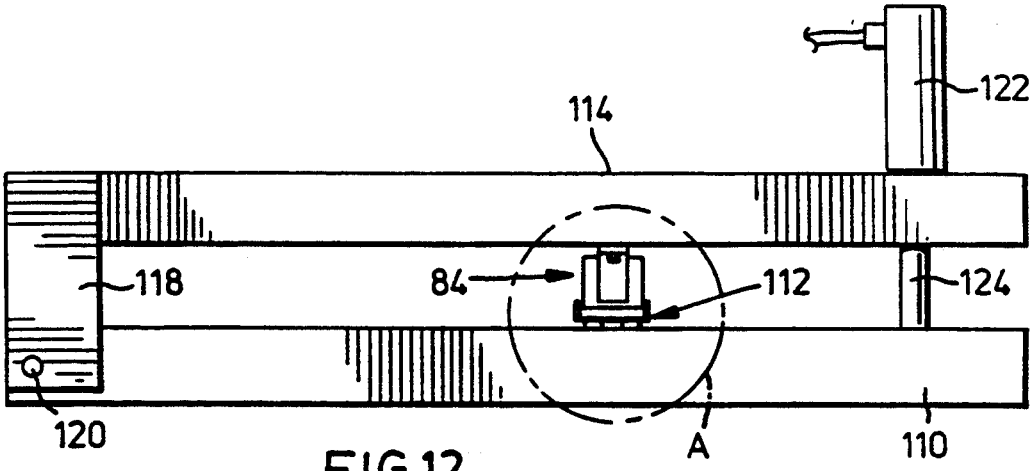
FIG. 12 is a side elevational view of the jig of FIG. 11 in a closed position.
Figure 13:
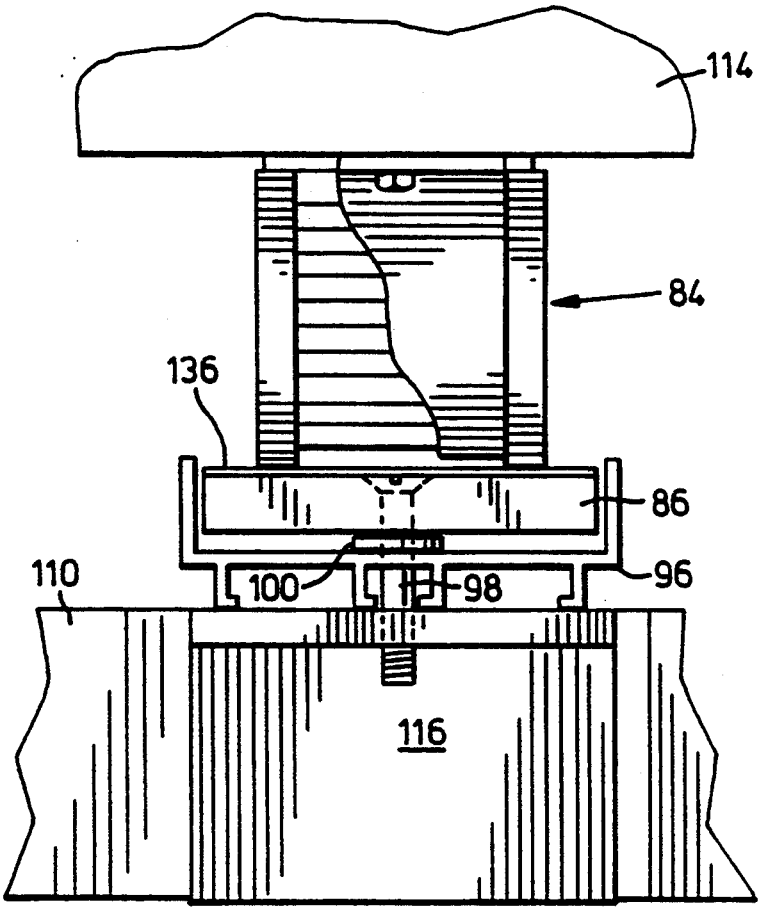
FIG. 13 is an enlarged view of the part of FIG. 12 circled at A.

FIGS. 11 to 13 illustrate the operation of calibrating the magnet/striker set and will be described later.

Continuing for the moment with the description of FIG. 3, magnet 84 is a commercially available permanent magnet and is carried by a support bracket 90 from a further bracket 92 that is interposed between and bolted to the bottom and side members of frame 36. FIG. 2 shows the panel release means 82 for one of the panels, and it will seen the magnet/striker assembly is positioned adjacent to the bottom of the panel approximately centrally of its width.

Referring back to FIG. 3, the striker 86 comprises a magnetically attractible plate that is secured to the rear face of panel 26 with the interposition of an extrusion 96 that effectively sets out the striker plate from the back of the panel. The striker plate is in fact bolted to extrusion 96 by a bolt indicated at 98 that passes through a NYLON washer 100 at the back of the striker plate and is fitted with a nut 98*a* inside the extrusion. Washer 100 allows the plate to "float" somewhat for ensuring proper face-to-face engagement with the magnet. Extrusion 96 is slightly longer than the width of the striker plate and is secured to the panel outwardly of the striker plate by two bolts that are threaded into a relatively substantial angle bracket 102 inside the panel. Bracket 102 acts to stiffen the panel at the point of attachment to the striker. Part of the shank of one of the attachment bolts for extrusion 96 is visible at 103. The bottom limb of stiffener 102 may be connected to the bottom frame member of the panel by a bolt indicated in dotted lines at 104.

In manufacturing a pressure relief panel assembly of the form provided by the invention, a magnet/striker set is calibrated so that the panel assembly in which the set is incorporated will release when the panel is subjected to a predetermined pressure from within the building. A magnet is selected having a rated holding force substantially excess of that which will be required in the panel assembly. It has been found that magnets having the same rated holding force can vary as much as plus or minus 25 to 30% from the rated force. For example, a magnet rated is having a holding force of 400 lbs. might in fact only be capable of holding 280 lbs. or could hold 520 lbs. Selection is therefore undertaken on the basis that the magnet will have more than adequate holding power even if its holding power is 30% less than the rated power. For example, a 400 lb. rated magnet might be selected for use in a panel in which the magnet is required to exert a maximum of, say 250 lbs. holding force. A selected magnet is then matched with a striker plate and the magnet/striker plate set is calibrated to the exact holding force required.

FIGS. 11 to 13 show a jig used in effecting this calibration, and will now be described.

Referring first to FIG. 11, the jig itself is generally denoted by reference numeral 106 and includes a base 108 to which is secured a fixed arm 110 for carrying a striker plate assembly (denoted 112), and a pivoted arm 114 for carrying the magnet. The magnet is denoted 84 to correspond with FIG. 3 and the striker plate itself is denoted 86 and is carried by extrusion 96. Bolt 98 attaches striker plate 86 to extrusion 96 as shown in FIG. 3. Extrusion 96 is bolted to arm 110 by two bolts 110*a* as shown in FIG. 13 so that the striker plate assembly is fixed to the arm. Brackets 116 at the sides of the arm accept the extrusion mounting bolts 110*a*.

The arm 114 that carries the magnet is pivoted to the end of the fixed arm 110 remote from the striker plate assembly 112 by brackets 118 of a length selected so that the two arms are essentially parallel when magnet 84 is in engagement with striker plate 86. The distance of the striker plate from the pivot axis of arm 114 (denoted 120) corresponds with the distance of the striker plate from the axis of pivot shaft 48 (FIG. 3) in the installed panel assembly.

An hydraulic cylinder 122 is mounted adjacent the outer end of the pivoted arm 114 with its axis at right angles to the pivot axis of the arm. The cylinder has a push rod 124 that extends through the arm and is of a length so that its outer end engages the top surface of the fixed arm 110 when the magnet is in engagement with the striker plate. An hydraulic pump 126 having an actuating handle 128 is fixed to the base 108 adjacent the fixed arm 110 and has an outlet connected by a hose 130 to the cylinder 122. A pressure gauge 134 is installed in the hose 130.

At the beginning of the calibration operation, the striker plate and magnet are secured to the respective arms as shown in FIG. 11 and the magnet is then brought into engagement with the striker plate by lowering arm 114 as shown in FIG. 12. The push rod 124 of cylinder 122 is then extended by operating the hand pump 126 until sufficient force is exerted to cause the magnet to release from the striker plate. The pressure at which the release occurs is indicated by gauge 134 and is recorded and converted to magnet release force. One or more non-magnetic shims (in this case of brass) are then added to the top surface of the striker plate and the process of forcing the arms apart by means of the cylinder 122 is repeated using different shim thicknesses until the magnet releases at a force corresponding to the force at which the panel is to release in the installed pressure relief panel assembly. FIG. 13 shows a single shim 136 on the top surface of striker plate 86. When the required shim thickness has been determined, or more shims of the required thickness are then bonded to the striker plate 86 using an appropriate adhesive. The striker plate and magnet are then a matched, calibrated set and are appropriately identified as such and are removed from the jig.

Figure 14:
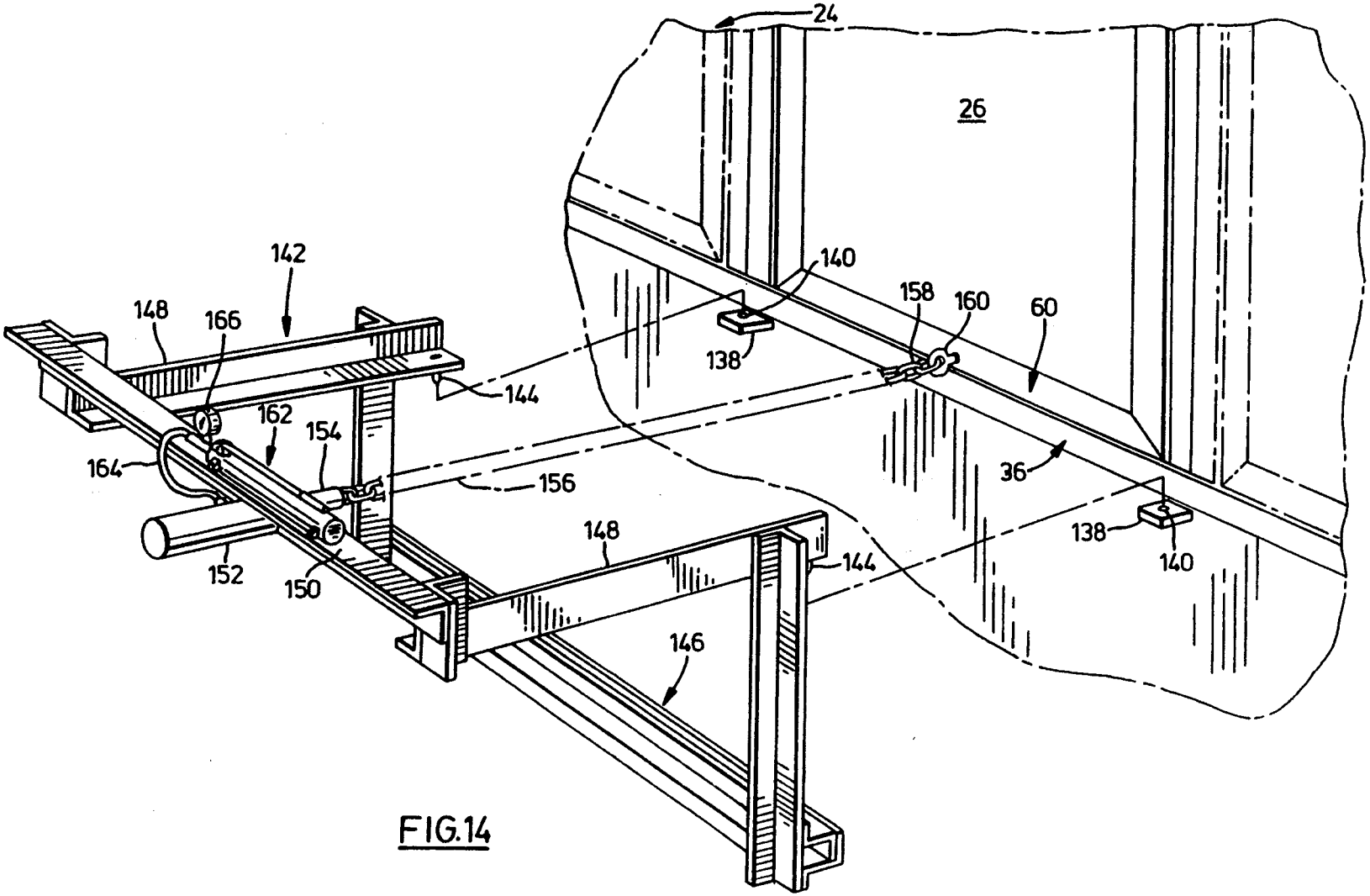
FIG. 14 is a perspective view of a test rig for determining the blow-out pressure of an installed panel.

FIG. 14 shows a test rig that can be used to determine the pressure at which a particular panel will release in situ (i.e. after the panel has been installed in the building). In FIG. 14, part of a panel array is shown in ghost outline at 24 and the panel to be tested is denoted 26.

The frame surrounding that panel is denoted 36. Protruding outwardly from the frame adjacent opposite sides are two horizonal lugs 138 having respective vertical openings 140. The lugs 138 are permanent parts of the frame 36 that have not been shown in previous views.

The test rig itself includes a frame 142 having pins 144 that are positioned to fit into the openings 140 in the lugs 136. A cross member 146 at the bottom of the frame bears against the building below the lugs 136. The frame also includes arms 148 that extend outwardly from the building when the rig is installed and that are joined at their outer ends by an upper cross member 150. Cross member 150 carries an hydraulic cylinder 152 that is oriented with its axis at right angles to and in alignment with the bottom frame member 60 of the panel 26. Cylinder 152 has a piston rod 154 to the outer end of which is connected a chain 156 having at its outer end a hook 158 that engages an eye 160 at the centre of frame member 60.

Frame cross member 150 carries a hand pump 162 similar to the pump 126 of FIG. 11. The pump has an operating handle 162 and an outlet that is connected by a hose 164 to cylinder 152. A pressure gauge 166 is connected in hose 164. The hose 164 is connected to the cylinder 152 so that the piston rod is retracted when hose 164 is under pressure.

To test the release pressure of a particular panel, the rig 142 is coupled to the installed panel assembly by engaging the pins 144 with the lugs 138 as described previously and the chain 156 is connected to the eyelet 160 by means of hook 158. Hand pump 160 is then operated until the pull exerted on the panel via chain 156 causes the panel to release. The pressure at which this occurs is indicated by gauge 166 and is recorded and converted to panel release force.

Rig 142 has been designed specifically for panel. assemblies of the form provided by the invention but could, in principle, be used to test the release pressure of panel assemblies of other forms. In the case of a panel assembly of the form provided by the invention, it would be possible to recalibrate the magnet/striker set if the release pressure is not found to be within specifications.

FIGS. 5 to 10 illustrate pressure relief panel assemblies in accordance with other embodiments of the invention. These assemblies all incorporate calibrated magnet/striker sets. Those sets can be considered as essentially the same as the magnet/striker set shown in FIG. 3, and will be identified by the same reference numerals.

Figure 5:
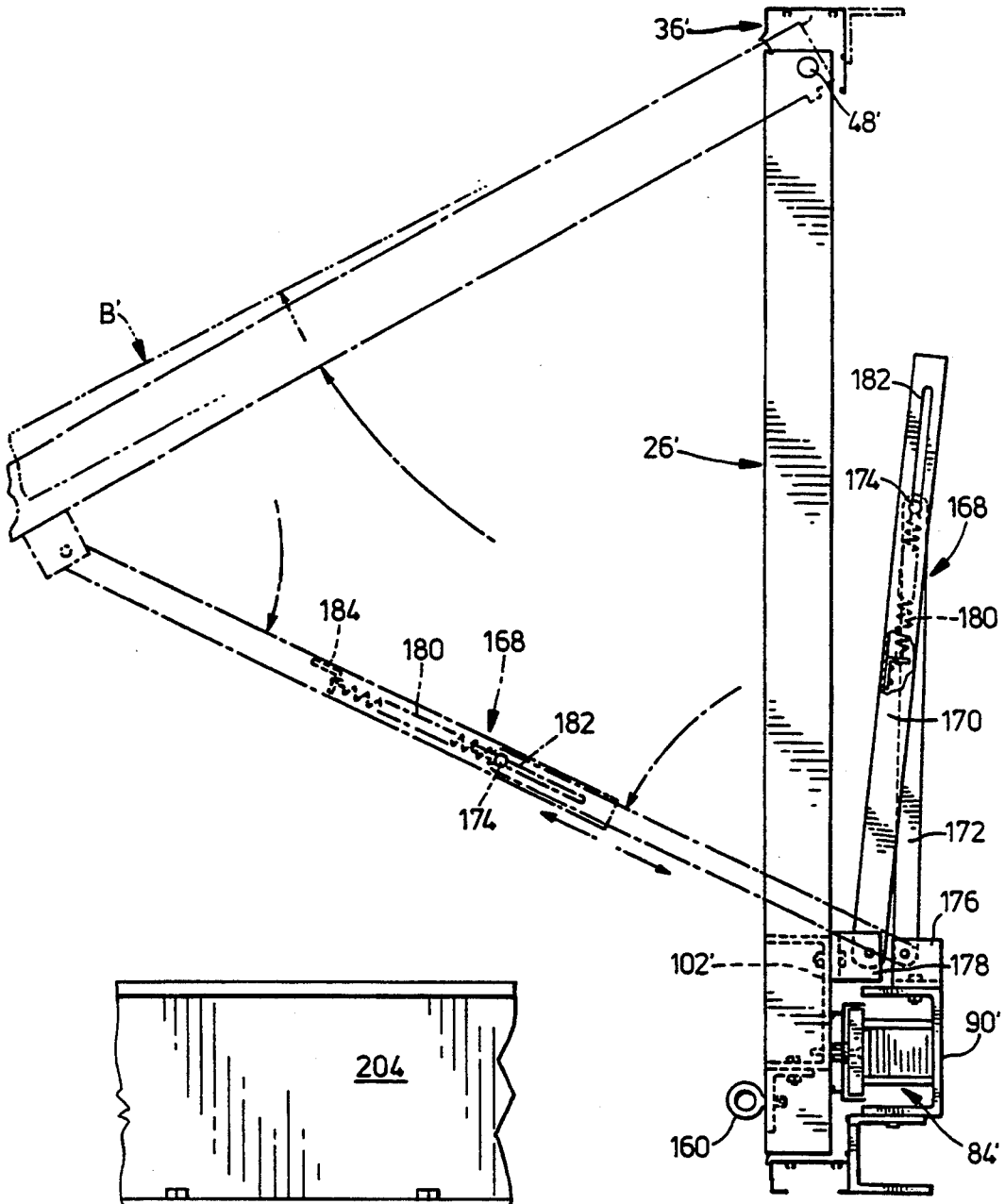
FIG. 5 is a diagrammatic illustration somewhat similar to FIG. 3 but showing a strut arrangement for cushioning opening of the panel.

Referring first to FIG. 5, the panel assembly shown in that view is essentially identical with the panel assembly shown in FIG. 3. The assembly has therefore been shown in diagrammatic form only and primed reference numerals have been used to denote parts that correspond with parts shown in FIG. 3. Thus, the panel itself is denoted 26' and is installed in a frame 36' so as to be pivotal about a pivot shaft 48' from the closed position in which it is shown in full lines to the open position in which it is shown in ghost outline at B'. Panel release means 82' normally hold the panel in its closed position.

As compared with the embodiment of FIG. 3, a cushioning strut assembly generally denoted 168 is connected between the panel and fixed structure for cushioning movement of the panel to its open position. The strut assembly adopts a collapsed configuration shown in full lines when the panel is closed and an extended position shown in ghost outline when the panel is open. The strut assembly comprises two struts 170 and 172 that are coupled together by a pivot pin 174. The outer ends of the respective struts are connected, one to the panel 26' and the other to a bracket 176 on the bracket 90' that supports the magnet 84' of the panel release means. Bracket 90' is a channel section bracket as compared with the angle section bracket shown in FIG. 3 but serves the same purpose as well as the additional purpose of providing a support for the strut mounting bracket 176. Strut 170 is pivoted at its outer end to a bracket 178 mounted on the rear side of panel 26'. Bracket 178 is in fact bolted to the internal stiffnet 102' within the panel. In this embodiment, the stiffnet 102' is also of channel section and extends the full width of the panel. The lower limb of the stiffner 102' acts as a mounting point for a bracket 180 that carries the eye 160 shown in FIG. 14 for attachment of the test rig 142. This eye is not shown in any of the other views but can of course easily be incorporated in any of the panels.

The pivot pin 174 between the two struts carried by the inner strut 172 and extends through a slot 182 that extends longitudinally of the outer strum 170. A tension spring 183 is connected between the pivot pin 174 and a bracket 184 on arm 170.

When the panel 26' is in its closed position and the strut assembly 168 is collapsed, pin 174 is at the far end of the slot 182; that is, the end nearest the end of strut 170 that is pivoted to bracket 178. When panel 26 prime is blown open, the struts are drawn to the straight line position shown in ghost outline. Pin 174 is initially at the outer end of slot 182 but as the panel continues to move out, strut 170 will be drawn outwardly with respect to strut 172 and the pin 174 will effectively move down the slot 182 against the tension of spring 183 (in fact, the slot will really move with respect to the pin). Spring 183 will thus cushion the last part of the movement of the panel to its open position B'.

Figure 6:
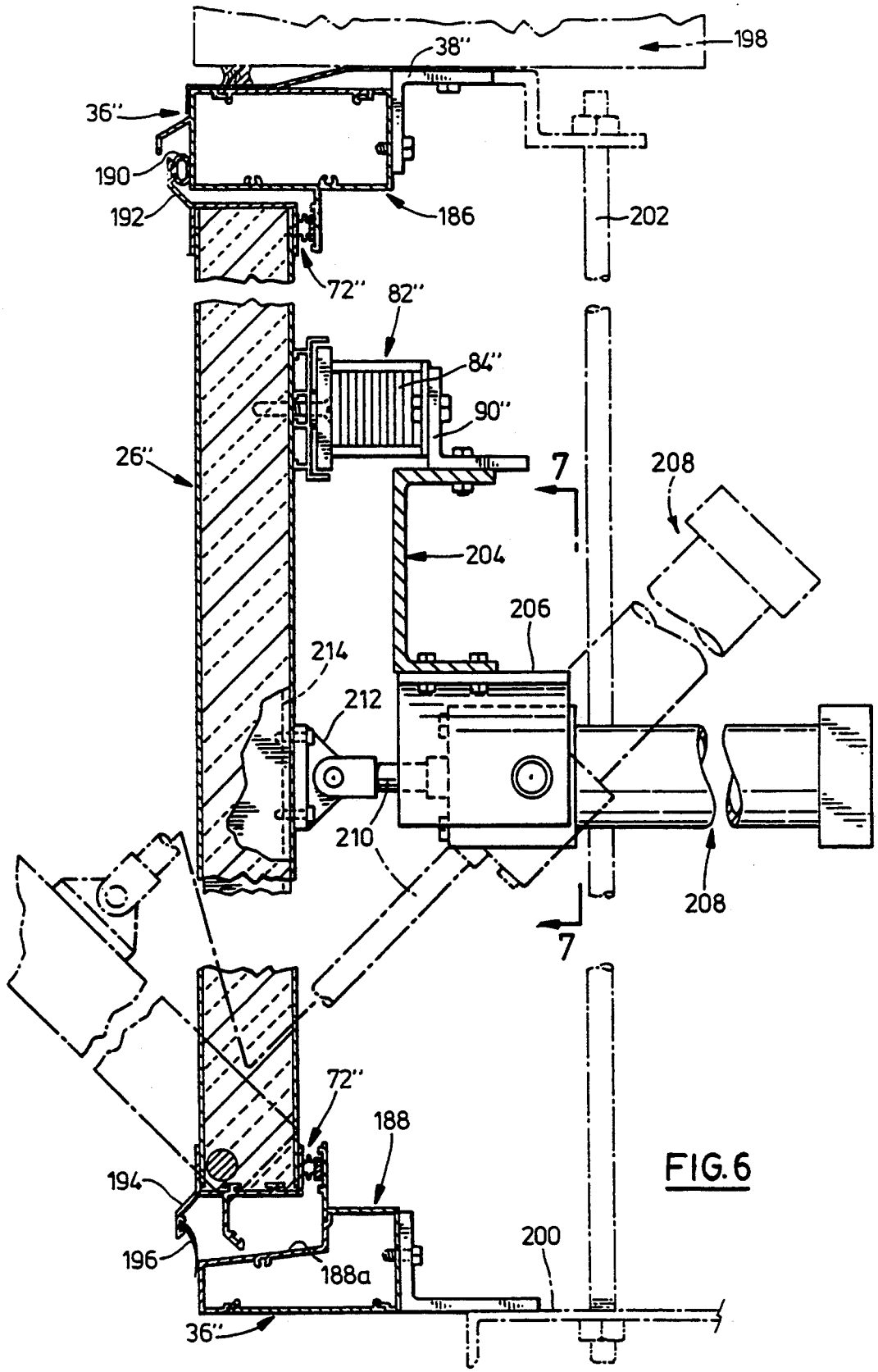
FIG. 6 is a view similar to FIG. 3 showing an alternative form of panel.
Figure 7:
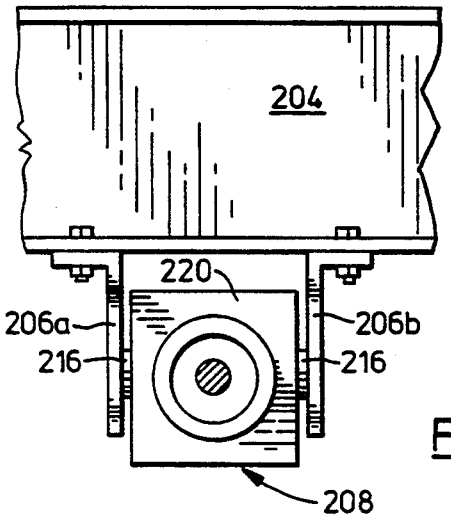
FIG. 7 is a sectional view on line 7—7 of FIG. 6.

FIG. 6 and 7 illustrate a further form of panel assembly and will now be described. In this case, the panel assembly is in principle similar to the assembly shown in FIG. 3 except in that the panel is pivoted adjacent its lower end and has magnetic panel release means adjacent its upper end. In addition, a pneumatic cylinder is used to cushion outward movement of the panel and can also be used to return the panel to its closed position after a blow-out situation has occurred. Double primed reference numerals have been used in FIGS. 6 and 7 to denote parts that correspond with parts shown in FIG. 2.

The panel itself is denoted 26'' and is mounted in a frame 36'' by a pivot pin 48'' adjacent the lower end of the panel. Thus, the panel can move from the closed position in which it is shown in full lines to the open position indicated in ghost outline at B''. A magnetic panel release assembly 82'' is provided adjacent to the upper end of the panel and is essentially the same as the assembly 82 of FIG. 3.

In this embodiment, the frame 36'' is made up of box section frame members, upper and lower ones of which are shown at 186 and 188 respectively. Magnetic seal assemblies 72'' are provided at the inner side of the panel. At the outer side of the panel, a circular section sealing strip 190 is carried by an external flange 192 along the top and side edges of the panel. As can be seen, when the panel is closed, the sealing strip 190 is compressed between the flange 192 and the frame 36''. Along the lower edge of the panel, a similar flange 194 carries a wiper-type sealing element 196. The bottom frame member 188 is recessed as indicated at 188*a* to accommodate inward movement of the seal when the panel opens.

Frame 36″ is carried by brackets 38″ that are coupled to fixed parts of the building indicated at 198 and 200 respectively. A sag rod 202 of the building is shown extending between the fixed parts 198 and 200.

In this embodiment, the fixed structure of the building also includes a cross member 204 of reverse C-section as seen in FIG. 6 that extends behind the panel between the side members of the panel frame. Cross member 204 carries the support bracket 90″ for the panel release assembly 82′. The cross member also carries a support bracket 206 for a pneumatic cylinder generally denoted 208. The cylinder is mounted horizontally behind the panel generally at the centre of its width and has a piston rod 210 which, at its outer end, is pivotally coupled to the panel by a clevis and bracket assembly 212. That assembly is in turn bolted to the panel and connected to a reinforcing plate 214 inside the panel.

As best seen in FIG. 7, the bracket 206 for the cylinder 208 in fact comprises two angle section members 206*a* and 206*b* disposed one on each side of the cylinder and supporting a pair of trunions 216, 218 that extend to a collar 220 around the cylinder. The trunions define a horizontal pivot axis that is at right angles to the longitudinal axis of the cylinder. This allows the cylinder to pivot downwardly when the panel is blown open as shown in ghost outline in FIG. 6.

Cylinder 208 is coupled in a pneumatic circuit (not shown) that is installed in the building. Cylinder 208 is provided with valves arranged so that outward movement of the piston rod 210 as a consequence of the panel being blown open is cushioned by controlled expulsion of air from the cylinder 208. The cushion effect should not of course be so severe as to inhibit free movement of the panel in response to an abrupt pressure rise within the building. In practice, therefore, air may be simply allowed to escape freely from an exhaust port in the cylinder and this will provide adequate cushioning. After the emergency situation has passed, the panel can be closed by releasing air from the pneumatic circuit into the exhaust port to retract the piston rod 210 and close the panel.

Figure 9:
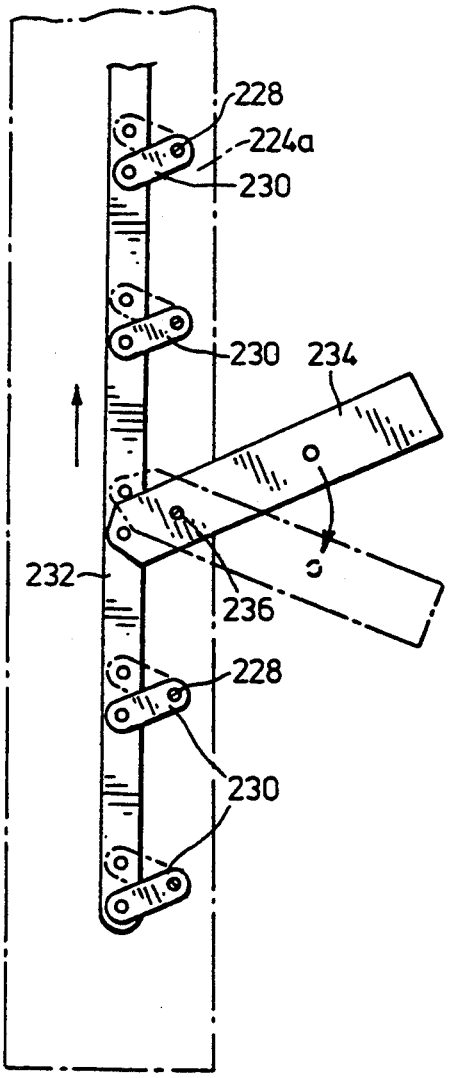
FIG. 9 is a diagrammatic elevational view of an operating linkage for the louver assembly.
Figure 8:
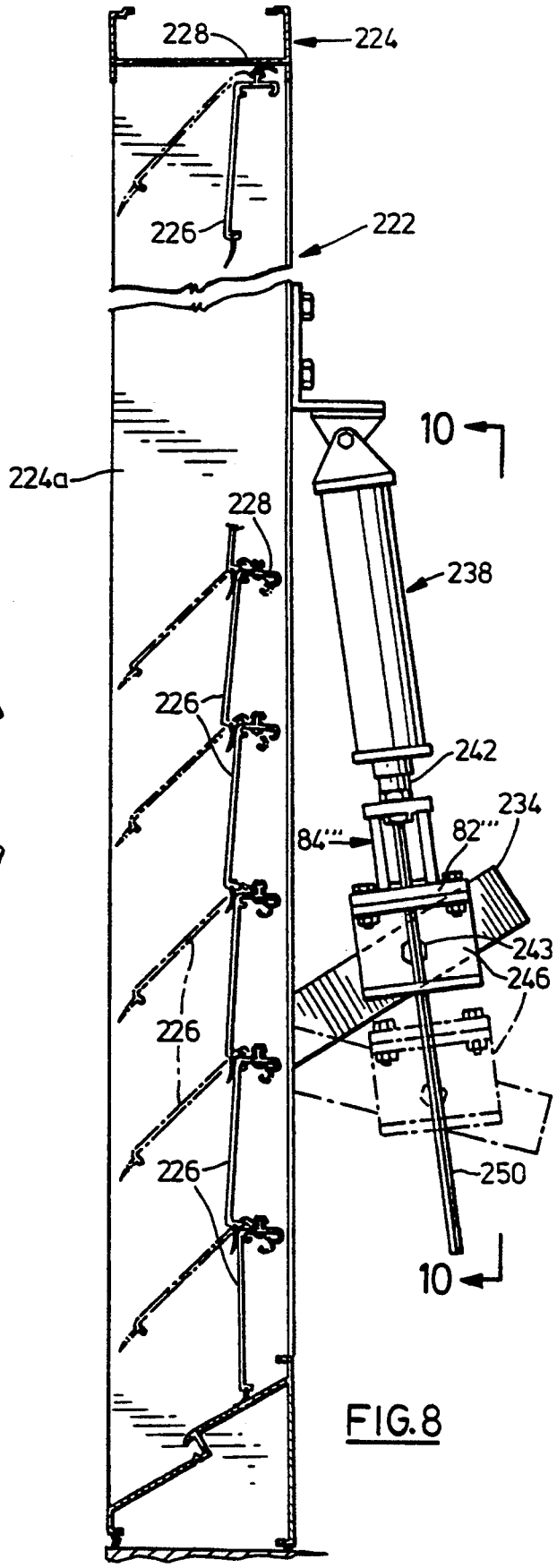
FIG. 8 is a vertical sectional view through a pressure relief louver assembly in accordance with a further embodiment of the invention.
Figure 10:
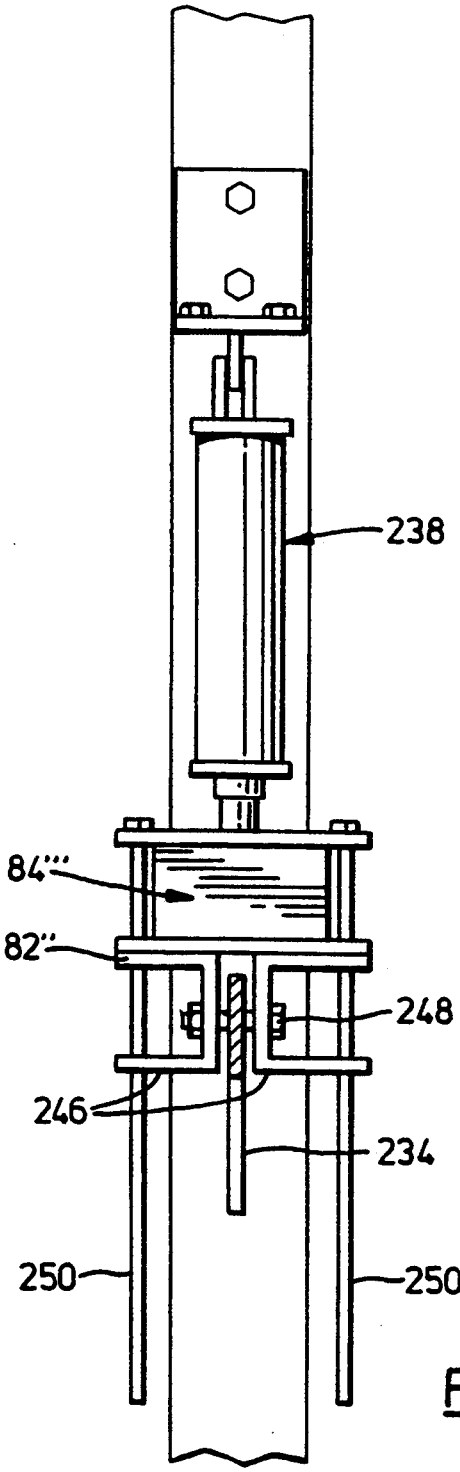
FIG. 10 is an elevational view generally in the direction of the arrows denoted 10—10 in FIG. 8.

FIGS. 8, 9 and 10 illustrate a still further embodiment of the invention in which the panel assembly incorporates a pressure-relief louver.

Referring first to FIG. 8, the assembly is generally denoted 222 and includes a frame 224 of outwardly facing channel section. A series of slats 226 extend transversely across the frame and are movable between the closed positions in which they are shown in full lines and the open positions indicated in ghost outline. Each slat is pivoted at its end to side members of frame 224 by pivot pins indicated at 228. In FIG. 8, only one of the the side frame members, denoted 224*a*, is visible behind the slats. FIG. 9 shows a louver operating linkage that is located behind member 224*a*. The slat pivot pins 228 are rigidly connected to respective links 230 that are in turn pivotly coupled to a vertically moveable link 232. An actuating link 234 is pivotally coupled to link 232 and is itself pivoted to the frame 224 at a pivot pin 236. Thus, if link 234 is moved downwardly at its outer end from the full line position in which it is shown to the ghost outline position indicated, then link 232 will be lifted, lifting the inner ends of the links 230, and opening the louver.

Referring back to FIG. 8, a pneumatic cylinder 238 is connected between a bracket 240 fixed to frame 224 and link 234 so that, by extending and retracting a piston rod within cylinder 238, the slats 226 can be opened and closed.

In order to permit the slats 226 to act as pressure relief panels, magnetic release means generally similar to those described previously are incorporated between the actuating link 234 and the cylinder 238. Thus, referring to FIG. 10, the cylinder 238 has a piston rod 244 that is connected to the actuating link 234 of the louver by a magnet/striker set 82‴ similar to that described previously. Specifically, a magnet 84‴ is carried by the piston rod 244 and cooperates with a striker plate 86‴ that is carried by a pair of C-section brackets 236 positioned one on each side of the actuating link 234 of the louver. A pivot pin 248 connects the brackets to link 234. A pair of rods 250 extend downwardly from the magnet and through clearance holes in the two brackets 246 to locate the brackets during a pressure relief condition. Thus, in the event of an abrupt pressure rise within the building, the slats 226 will be blown outwardly to the ghost outline positions shown in FIG. 8. This in turn will draw link 232 upwardly (FIG. 9) and cause the actuating link 234 to move to the ghost outline position shown in that view. Link 234 will bring with it the brackets 246 and the striker plate 86‴ to the ghost outline position shown in FIG. 8 and the striker plate will be forced to separate from the magnet 84‴. After the emergency condition has passed, piston 244 can be extended so that the magnet will move down and "pick up" the striker plate. The rod can then be retracted close the louver.

It will of course be understood that the preceding description relates to particular preferred embodiments of the invention only and that many modifications are possible within the broad scope of the invention.

For example, although reference has been made in connection with various embodiments to the use of pneumatics, it will of course be understood that the equivalent hydralic means may be used.

Also, changes may of course be made in the design of the panels, frames and related parts.

I claim:

1. A building having an outer wall, and a pressure relief panel assembly installed in said outer wall to relieve pressure above a predetermined blow-out pressure within said building, said assembly comprising: a frame mounted in a vertical plane in said outer wall; a blow-out panel; means pivotally coupling said panel at the top or bottom of said panel to the frame for movement of said panel from a normal closed position in said vertical plane to an open position inclined from said vertical plane in response to an increase in pressure within said building above said predetermined blow-out pressure; and a calibrated panel release means normally holding the panel in its closed position but adapted to release when the panel is subjected to the predetermined blow-out pressure, the panel release means including a magnet and striker set, one of which is carried by the panel and the other of which is carried by the frame, the magnet having a maximum holding force substantially in excess of a known force to which the panel is subjected at the predetermined blow-out pressure, and a non-magnetic shim between the magnet and the striker and being affixed to one of the magnet and striker, the shim having a selected thickness which increases the spacing between the striker and the magnet and thus reduces the effective holding force exerted on the striker by the magnet to said known force.

2. A building as claimed in claim 1, wherein said frame further comprises an inwardly directed flange extending around the perimeter of said frame inwardly of and spaced from a marginal portion of the panel when the panel is in its said closed position, and wherein the assembly further comprises a magnetic seal between said flange and panel, comprising an elongate magnet flexibly coupled to one of said flange and panel, and a magnetically attractable strip carried by the other of said flange and panel, whereby the magnet attaches to said strip and forms said seal in the closed position of the panel, and separates from said strip as the panel moves to its open position.

3. A pressure relief panel assembly installed in an outer wall of a building to relieve pressure above a predetermined blow-out pressure within the building and comprising: a frame mounted in the wall of the building; a blow-out panel pivotally coupled to the frame for movement from a normal closed position to an open position in response to an increase in pressure within the building above said predetermined blow-out pressure; and a calibrated panel release means normally holding the panel in its closed position but adapted to release when the panel is subjected to the predetermined blow-out pressure, the panel release means including a magnet and striker set, one of which is carried by the panel and the other of which is carried by the frame, the magnet being selected from a group of magnets having nominal holding forces substantially in excess of a known force to which the panel is subjected at the predetermined blow-out pressure and having actual holding forces which vary from said nominal holding forces, said magnet having an actual holding force which is also substantially in excess of said known force, and a shim between the magnet and the striker and being affixed to one of the magnet and striker, said shim having a selected thickness and being of a selected material which increases the spacing between the striker and the magnet by an amount which, when said panel is in its closed position, reduces the holding force exerted by said magnet on said striker to said known force, said selected thickness being determined by interposing a shim of said selected thickness and selected material between said magnet and said striker and then determining the force required to separate said magnet from said striker.

4. The panel assembly according to claim 3 wherein said panel comprises an outward peripheral edge portion facing outwardly of said building, and an inward peripheral edge portion facing in a direction opposite to said outward peripheral edge portion, said assembly including an outer peripheral seal extending between said frame and said panel adjacent said outward peripheral edge portion and providing an outer seal, and an inner seal located between and connected to one of said frame and said inward peripheral edge portion, said outer and inner seals each separating from one of said panel and said frame when said panel moves from said closed to said open position.

5. The panel assembly according to claim 3 wherein said panel has a top surface, a bottom surface, and side surfaces extending between said top and bottom surfaces, and pivot means extending horizontally between said side surfaces and said frame, said pivot means being located below but adjacent said top surface.

6. A pressure relief panel assembly for installation in an outer wall of a building to relieve pressure above a predetermined blow-out pressure within a building and comprising: a frame for mounting in the wall of the building; a blow-out panel pivotally coupled to the frame for movement from a normal closed position to an open position in response to an increase in pressure within the building above said predetermined blow-out pressure; and a calibrated panel release means normally holding the panel in its closed position but adapted to release when the panel is subjected to the predetermined blow-out pressure, the panel release means including a magnet and striker set, one of which is carried by the panel and the other of which is carried by the frame, the magnet having a maximum holding force substantially in excess of a known force to which the panel is subjected at the predetermined blow-out pressure, and a non-magnetic shim between the magnet and the striker and being affixed to one of the magnet and striker, the shim having a selected thickness which increases the spacing between the striker and the magnet and thus reduces the effective holding force exerted on the striker by the magnet to said known force.

7. An assembly as claimed in claim 6, wherein said frame further comprises an inwardly directed flange extending around the perimeter of said frame inwardly of and spaced from a marginal portion of the panel when the panel is in its said closed position, and wherein the assembly further comprises a magnetic seal between said flange and panel, comprising an elongate magnet flexibly coupled to one of said flange and panel, and a magnetically attractable strip carried by the other of said flange and panel, whereby the magnet attaches to said strip and forms said seal in the closed position of the panel, and separates from said strip as the panel moves to its open position.

8. An assembly as claimed in claim 7 in which the panel in closed position has inner and outer sides, further comprising flexible sealing elements at the outer side of the panel adapted to co-operate with the frame in said closed position of the panel to form an external seal.

9. An assembly as claimed in claim 6, wherein said panel comprises a peripheral frame, a pair of spaced inner and outer panel members surrounded by the frame, and insulation filling the space between said panel members.

10. An assembly as claimed in claim 9, wherein said panel is pivotally coupled to the frame adjacent a first end of the panel and wherein said magnet and striker set is disposed adjacent a second end of the panel, the panel further including an internal stiffener inwardly of said inner panel member to which the relevant one of said streaker and magnet is coupled through said inner panel member, said stiffener being generally L-shaped and extending inwardly of said member and along said second end of the panel.

11. An assembly as claimed in claim 6, further comprising a pivoted linkage connected between said panel and a fixed structure for movement between a collapsed position when the panel is closed and an extended position when the panel is open, and spring means arranged to resist movement of said linkage from its collapsed position to its extended position, to cushion opening of the panel.

12. An assembly as claimed in claim 6, wherein the shim is secured to the striker and defines a face for contact with the magnet.

13. An assembly as set forth in claim 6, further comprising a pivotal linkage connected between the panel and a fixed structure for limiting the pivoted movement of the panel in open position.

14. A method of calibrating a magnet and striker set of panel relief means forming part of a pressure relief panel assembly for installation in an outer wall of a building to relieve pressure above a predetermined blow-out pressure within a building and having a frame for mounting in the wall of the building and a blow-out panel pivotally coupled to the frame for movement from a normal closed position in response to an increase in pressure within the building above the predetermined blow-out pressure and panel release means normally holding the panel in its closed position but adapted to release when the panel is subjected to the predetermined blow-out pressure, the method comprising the steps of:

providing a magnet having a maximum holding force substantially in excess of a known force to which the panel is subjected to at the predetermined blow-out pressure;

providing a striker for co-operation with the magnet;

mounting one of the magnet and striker on the panel and mounting the other on the frame;

providing a non-magnetic shim; and locating the shim between the magnet and the striker to space the striker and magnet and reduce the effective holding force exerted on the striker by the magnet, the thickness of the shim being selected to reduce said effective holding force to said known force.

15. The method of claim 14 and further including the step of fixing the shim to the striker to define a face for contact with the magnet.

16. The method of claim 14 and further including the step of providing a plurality of shims for location between the magnet and the striker, the total thickness of the shims being selected to reduce said effective holding force to said known force.

17. A method of protecting a building from structural damage from sudden rises in internal pressure by relieving pressure above a predetermined blow-out pressure within the building comprising:

mounting a frame in an outer wall of the building;

providing a blow-out panel pivotally coupled to the frame for movement from a normal closed position to a pressure relieving open position in response to an increase in pressure within the building above said predetermined blow-out pressure; and providing a calibrated panel release means for normally holding the panel in its closed position but adapted to release when the panel is subjected to the predetermined blow-out pressure and including a magnet and striker set, one of which is carried by the frame and the other of which is carried by the panel, the magnet having a maximum holding force substantially in excess of a known force to which the panel is subjected at the predetermined blow-out pressure, providing a non-magnetic shim between the magnet and the striker and affixing said shim to one of them, selecting the thickness of said shim to a value which increases the spacing between the striker and the magnet to an amount which reduces the effective holding force exerted on the striker by the magnet to said known force.

18. A method of providing a calibrated panel release means for a pressure relief panel assembly for installation in the outer wall of a building to relieve pressure above a predetermined blow-out pressure within the building, the assembly comprising a frame for mounting in the wall of the building and a blow-out panel pivotally coupled to the frame for movement from a normal closed position to an open position in response to an increase in pressure within the building above said predetermined blow-out pressure and a magnet and striker plate set interposed between the panel and the frame, said method comprising the steps of:

(a) selecting the magnet to have a maximum holding force substantially in excess of a known force to which the panel is subjected at the predetermined blow-out pressure, (b) determining the thickness of shim means which must be interposed between the magnet and the striker plate to decrease the holding force of the magnet on the striker plate to said known force, such thickness thereby being a predetermined thickness, and (c) connecting said shim means of said predetermined thickness to one of said magnet and said striker with said shim means interposed between the magnet and the striker plate.

19. The method according to claim 18 wherein said step (a) comprises selecting said magnet from a group of magnets each having a nominal holding force substantially in excess of said known force and wherein the actual holding forces of at least some of said magnets vary from said nominal holding force, and wherein said step (b) comprises interposing said shim means between said magnet and said striker plate and then determining the force required to separate said magnet from said striker plate.

20. The method according to claim 19 wherein the force required to separate said magnet from said striker plate with said shim means therebetween is determined by coupling a linkage which includes a piston and cylinder between said magnet and said striker plate, applying pressure in said piston and cylinder until said magnet separates from said striker plate, and measuring the pressure applied to said piston and cylinder at which said magnet separates from said striker plate.

21. A method of protecting a building from internal damage from sudden rises in internal pressure by relieving pressure above a predetermined blow-out pressure within the building, said building being of the kind having a frame mounted in an outer wall of the building, said method comprising the steps of:

(a) providing a blow-out panel pivotally coupled to the frame for movement from a normal closed position to a pressure relieving open position in response to an increase in pressure within the building above said predetermined blow-out pressure, (b) providing a calibrated panel release means for normally holding the panel in its closed position but adapted to release when the panel is subjected to the predetermined blow-out pressure thereby causing a known force on said panel, said panel release means including a magnet and striker plate set, one of which is carried by the frame and the other of which is carried by the panel, (c) calibrating said panel release means by:

(1) selecting said magnet from a group of magnets each having a nominal holding force substantially in excess of said known force and having actual holding forces which vary from said nominal force, said magnet having an actual holding force substantially in excess of said known force, (2) providing positioning means for positioning said magnet in a predetermined position relative to said striker plate when said magnet and striker plate set is closed, said predetermined position being such that the holding force of said magnet on said striker plate is reduced to said known force, said predetermined position being determined by placing said magnet and striker plate in a selected position relative to each other, determining the force required to separate said magnet from said striker plate, and then altering said selected position until the force required to separate said magnet from said striker plate is said known force, the selected position at the time when the force required to separate said magnet from said striker plate is said known force being said predetermined position, (d) and attaching said magnet and striker plate with said positioning means to said frame and panel such that when said panel is in its closed position, said magnet has said predetermined position relative to said striker plate.

22. The method according to claim 21 wherein said positioning means comprises a shim, said step (c)(2) and said step (d) comprising interposing said shim between said magnet and said striker plate.

23. The method according to claim 21 wherein the force required to separate said magnet from said striker plate when said magnet and said striker plate are in a said selected position is determined by coupling a linkage including a piston and cylinder between said magnet and said striker plate, applying pressure in said piston and cylinder until said magnet separates from said striker plate, measuring the pressure in said piston and cylinder at which said magnet separates from said striker, and utilizing such pressure to determine said force.

24. The method according to claim 22 wherein said step (c)(2) comprises determining the thickness of said shim required to decrease the holding force of said magnet on said striker plate to said known force.

* * * * *